United States Patent [19]

Feinberg et al.

[11] 4,436,240

[45] Mar. 13, 1984

[54] METHOD FOR PLATING DIELECTRIC ELEMENTS IN AN ISOLATOR AND FOR ASSEMBLING THE ISOLATOR

[75] Inventors: Jay H. Feinberg, Deerfield; Terrance Knowles, Lincolnshire, both of Ill.

[73] Assignee: Zenith Radio Corporation, Glenview, Ill.

[21] Appl. No.: 365,423

[22] Filed: Apr. 5, 1982

[51] Int. Cl.[3] ..... C23C 3/02

[52] U.S. Cl. ..... 228/122; 228/133; 228/180 R; 228/249; 228/254; 427/80; 427/259; 427/304

[58] Field of Search ..... 427/80, 259, 304; 228/122, 133, 180 R, 249, 254

[56] References Cited

U.S. PATENT DOCUMENTS 4,107,351 8/1978 James ..... 427/304

4,311,729 1/1982 Itakura ..... 427/80

*Primary Examiner*—John D. Smith

[57] ABSTRACT

A method is described for plating the inner and outer circumferences of a cylindrical dielectric element used in an isolator, and for then assembling the dielectric element with other components to complete the isolator. The dielectric element is first sensitized and activated so that a subsequently applied plating will adhere thereto. The end faces of the dielectric element are then covered with a plating resist, and the element is immersed in a metal plating bath to plate the inner and outer circumferences of the dielectric element. Having been plated, the dielectric element and other components of the isolator are assembled within a hollow connector and joined thereto using a solder sheath.

2 Claims, 2 Drawing Figures

METHOD FOR PLATING DIELECTRIC ELEMENTS IN AN ISOLATOR AND FOR ASSEMBLING THE ISOLATOR

BACKGROUND OF THE INVENTION

This invention is directed to an improved method of manufacturing antenna isolators of the type used with television receivers.

Antennas and other video signal sources are now being isolated from A.C. line voltages which may appear at the tuner of a television receiver. One of the most convenient and effective forms of isolators for this purpose is described in U.S. application Ser. No. 282,824, filed July 13, 1981 now U.S. Pat. No. 4,399,419. A portion of one such isolator is shown in FIG. 1, to which reference is now made.

The illustrated portion 10 of the isolator includes a cylindrical ferrite bead 12 having a central aperture 12*a*, a cylindrical dielectric element 14 having a central aperture 14*a*, and another cylindrical dielectric element 16 having a central aperture 16*a*. The ferrite bead 12 is normally sandwiched between the dielectric elements 14 and 16 to form a unitary structure.

The dielectric element 14 has a conductive metal coating on its outer circumference 18 and another conductive metal coating on its inner circumference 20. The end face 22 of the element 14 is free of any metal coating and is typically bonded to an immediately adjacent end face of the ferrite bead 12 by an epoxy adhesive.

The dielectric element 16 is constructed similarly to the element 14 and is bonded to the end face 24 of the ferrite bead. The resulting unitary assembly may then be housed within a metal connector with the metal coatings on the outer circumferences of the elements 14, 16 soldered to the inner surface of the connector to form concentric capacitors.

The problems addressed by this invention relate to the manner of plating the dielectric elements 14 and 16 and the manner in which the isolator is assembled within its connector. Previously, the elements 14, 16 have initially had their entire surface areas coated with metal. Their end faces, such as end face 22, were then lapped to remove therefrom the previously plated metal. Although the resulting capacitors operated satisfactorily, lapping tends to be time consuming and, therefore, an expensive operation for high volume production.

Proper mounting of the isolator within its connector includes soldering the metallized outer circumferences of the dielectric elements to an adjacent inner surface of the connector. This assembly step has proven to require considerable care since the surfaces to be soldered are difficult to access. In practice, one of the limiting factors on the isolator's yield has been the ability to quickly and properly effect this step of the assembly.

Accordingly, it is a general object of the invention to provide an improved method of fabricating an isolator of the type described above.

It is a more specific object of the invention to provide an improved method of depositing a metal coating on the inner and outer circumferences of the isolator's dielectric elements.

It is another object of the invention to provide an improved method of joining the isolator to its connector housing.

BRIEF DESCRIPTION OF THE FIGURES

The objects stated above and other objects of the invention are set forth more particularly in the following detailed description and the accompanying drawings, of which.

DESCRIPTION OF THE PREFERRED EMBODIMENT

Figure 1:
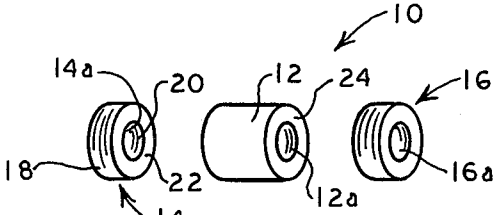
FIG. 1, previously described, illustrates a portion of a three element isolator which is assembled according to the invention and whose dielectric elements are plated according to the invention.

The present invention provides an improved method of plating dielectric elements such as those shown in FIG. 1, and an improved method of assembling the isolator within a connector housing. The improved plating method will be described first, using the elements depicted in FIG. 1 as an example of how the invention may be practiced.

Starting with the bare dielectric element 14, the entire surface area thereof is first sensitized so that a later applied activator will adhere thereto. Next, an activator is applied to the dielectric element in a manner such that its entire surface is conditioned to receive and hold a metal plating thereon.

The end face 22 and the opposing end face (not shown) of the dielectric element are then covered with a plating resist. No plating resist is permitted to cover the inner circumference 20 or the outer circumference 18. Following the application of the plating resist, the dielectric element may be lightly reactivated by immersion in a bath of hydrochloric acid, for example, in preparation for the receipt of a metal plating.

The dielectric element is then plated as by immersing it in a metal plating bath. Because of the resist previously applied to the end face 22 and its opposing end face, metal does not adhere to these surfaces. However, the metal does plate the inner circumference 20 and the outer circumference 18, thereby forming a concentric capacitor between these plated surfaces. Since the end faces of the dielectric element receive no plating, they need not be lapped to remove any metal therefrom. A costly and time consuming step is thereby eliminated in the fabrication of the isolator.

The preferred steps of the plating process are based on the use of a dielectric element which is made of barium titanate. In this case, the dielectric element is sensitized with tin chloride, then activated by dipping it in an acid solution of palladium chloride, and then air dried. The palladium chloride anchors to the tin chloride and will cause the subsequently applied metal plating to adhere to exposed areas of the palladium chloride.

The preferred plating resist is an ultraviolet curable acrylic which is applied to the end faces of the dielectric element as by a conventional screening process. Preferably, the plating resist is also an electrical insulator to insulate the dielectric element 14 from the ferrite bead 12 when they are assembled in abutting relationship. An example of such a resist is designated commercially as Dynachem SM-18.

The acrylic plating resist may be screened onto the end faces to a thickness of from about 0.3 to about 0.6 mils. The resist may then be cured for about one minute under a flow of nitrogen and under relatively weak ultraviolet illumination.

After curing, the dielectric element is lightly reactivated, preferably by dipping it into a ten percent aqueous solution of hydrogen chloride. The metal plating, preferably nickel, is then applied to the inner and outer circumferential surfaces of the dielectric element by dipping the element into a nickel bath.

In addition to eliminating the need for lapping metal plating from the end faces, another advantage of the present process is that no additional insulator need be applied to the end faces of the dielectric elements. Prior processing techniques have typically included applying an insulating spoxy coating over the end faces of both dielectric elements so as to bind the dielectric elements to the ferrite bead and to simultaneously insulate the ferrite bead from the dielectric elements. The three element isolator thus formed was then inserted into a hollow connector shell and soldered thereto at the location of the plated outer circumferences of the dielectric elements. With the present process, the acrylic resist insulates the end faces of the dielectric elements from the ferrite bead. Moreover, the dielectric elements need not be bonded to the ferrite bead in assembling the insulator as described below.

Figure 2:
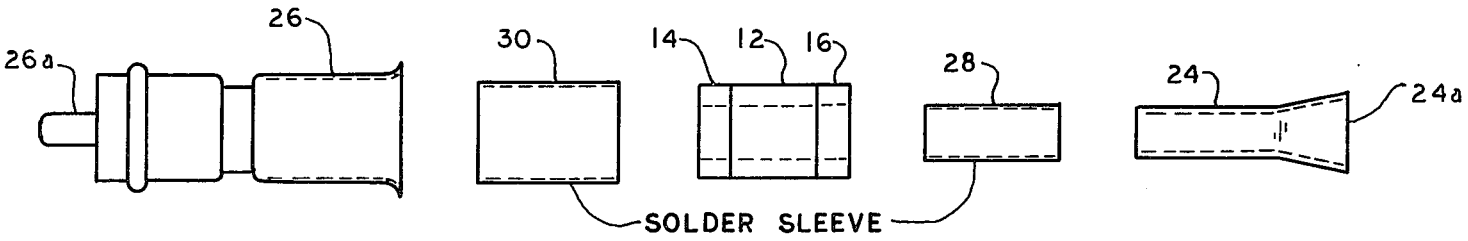
FIG. 2 depicts various components of an exemplary complete isolator to illustrate the manner in which it is assembled.

Referring now to FIG. 2, the dielectric elements 14 and 16 are shown as abutting, but not bonded to, the ferrite bead 12. Both dielectric elements have been processed as described above to provide a metal plating on their inner and outer circumferences, with insulating resist on their end faces. The metal plating on the inner circumferences of the dielectric elements will be soldered to the outer surface of a hollow tubular conductor 24, and the outer circumferences of the dielectric elements will be soldered to the inner surface of a hollow connector shell 26.

To assemble the illustrated structure, a thin solder sleeve 28 is slipped over the outer surface of the tubular conductor 24. Then the conductor 24, mated with the solder sleeve 28, is inserted into the central apertures of the elements 16, 12 and 14. Thus, the sleeve 28 is held between the outer surface of the conductor 24 and the inner circumferences of the dielectric elements 14, 16 and the ferrite bead 12. In this operation, the elements 12, 14 and 16 may be held together manually or by machine.

Another thin solder sleeve 30 is then slipped over the outer surfaces of elements 12, 14 and 16 and the structure assembled thus far is inserted into the hollow connector shell 26. The sleeve 30 is thus positioned between the inner surface of the connector shell 26 and the outer circumferences of elements 12, 14 and 16.

Thus assembled, the entire structure is heated to melt the solder and permit it to flow to surfaces to which it can bond. Solder bonds are thus formed between the inner surfaces of the connector shell 26 and the plated outer circumferences of the dielectric elements 14 and 16 by virtue of the solder sleeve 30. Similar bonds are formed between the outer surface of the conductor 24 and the inner plated circumferences of the dielectric elements 14, 16. With this arrangement, the tubular conductor 24 is capacitively coupled to the connector shell 26 by means of the capacitors formed by the plated dielectric elements.

In a typical application of the isolator, the shield of a coaxial cable is soldered to the flared portion **24*a* of the tubular conductor 24. The cable's inner conductor is fed through, without contacting, the tubular conductor 24 and the elements 12, 14 and 16, and soldered to a connector pin 26*a* which is insulated from the shell of the connector 26. Thus, any A.C. line voltage which appears on the cable's shield is insulated from the shell of connector 26**, while the field within the cable is protected from ambient electromagnetic interference.

The method described above for plating the dielectric elements and for assembling the isolator reduces the cost of the isolator without degrading its performance. It is particularly attractive for high volume production.

Although the invention has been described in terms of preferred steps and materials, it will be obvious to those skilled in the art that many modifications and alterations may be made without departing from the invention. Accordingly, it is intended that all such modifications and alterations be considered as within the spirit and scope of the invention as defined by the appended claims.

What is claimed is:

1. For an isolator comprising a hollow, cylindrical ferrite bead sandwiched between a pair of hollow, cylindrical dielectric elements having metal plated inner and outer circumferences and non-plated inner and outer circumferences, a method for plating the end faces and for assembling the isolator within a hollow connector shell, comprising:

sensitizing and activating the dielectric elements such that a subsequently applied plating will adhere thereto;

covering the end faces of the dielectric elements with a non-conductive plating resist;

immersing the dielectric elements in a metal plating bath to plate the inner and outer circumferences of the dielectric elements;

sandwiching the ferrite bead between the plated dielectric elements such that the dielectric elements abut the ferrite bead without being bonded thereto;

providing a tubular conductor sized to fit within said dielectric elements and ferrite bead;

surrounding the tubular conductor with a thin solder sheath;

inserting the tubular conductor with the solder sheath thereon into the assembled dielectric elements and ferrite bead;

surrounding the assembled dielectric elements and ferrite bead with a second thin solder sheath;

inserting the assembled dielectric elements and ferrite bead with the second solder sheath thereon into the connector shell; and heating the entire structure so as to solder the tubular conductor to the plated inner circumferences of the dielectric elements and to solder the connector shell to the plated outer circumferences of the dielectric elements.

2. A method as set forth in claim 1 wherein said plating resist is an ultraviolet curable acrylic.

* * * * *